US009815079B2

(12) United States Patent
Taylor

(10) Patent No.: US 9,815,079 B2
(45) Date of Patent: Nov. 14, 2017

(54) SPRAY BOTTLE HAVING ROTATABLE STEM AND ASSOCIATED METHODS

(71) Applicant: Bradley Taylor, Melbourne, FL (US)

(72) Inventor: Bradley Taylor, Melbourne, FL (US)

(73) Assignee: Bradley Taylor, Melbourne, FL (US)

( * ) Notice: Subject to any disclaimer, the term of this patent is extended or adjusted under 35 U.S.C. 154(b) by 146 days.

(21) Appl. No.: 14/879,376

(22) Filed: Oct. 9, 2015

(65) Prior Publication Data

US 2017/0100735 A1 Apr. 13, 2017

(51) Int. Cl.
*B05B 15/00* (2006.01)
*B05B 11/00* (2006.01)

(52) U.S. Cl.
CPC ..... *B05B 15/005* (2013.01); *B05B 11/3014* (2013.01)

(58) Field of Classification Search
CPC ..... B05B 11/0089; B05B 15/005; B05B 11/3014
USPC .... 222/383.1, 321.5, 377, 464.7, 382, 464.1
See application file for complete search history.

(56) References Cited

U.S. PATENT DOCUMENTS 5,152,431 A * 10/1992 Gardner ..... B67D 7/0205 222/136
5,464,129 A * 11/1995 Ho ..... B05B 11/0037 222/377
2006/0086759 A1* 4/2006 Herzog ..... B05B 15/005 222/321.9
2007/0210122 A1 9/2007 Giovannoni
2010/0096415 A1* 4/2010 Dennis ..... B05B 11/0037 222/464.1
2011/0036927 A1* 2/2011 Hensen ..... B05B 11/0037 239/302
2012/0234871 A1* 9/2012 Good ..... B05B 11/0016 222/382

* cited by examiner

*Primary Examiner* — Nicholas J Weiss
*Assistant Examiner* — Robert Nichols, II
(74) *Attorney, Agent, or Firm* — Mark Malek; Kelly G. Swartz; Widerman Malek, PL

(57) ABSTRACT

A liquid take-up mechanism may be used in connection with a spray bottle having a first and second vertical tube section, an internal member capture, a horizontal tube section, an angled tube section, and a rotation connection member. The internal member capture may be adjacent the first and second vertical tube sections. The horizontal tube section may be secured to the second vertical tube section. The angled tube section may be secured to the horizontal tube section. The rotation connection member may have a housing and an internal member, which may be carried by the internal member capture. The first and second vertical tube sections may be adapted to be carried by the housing. The internal member may be adapted to interface between the first and second vertical tube sections. The second vertical tube section may be able to freely rotate with respect to the first vertical tube section.

19 Claims, 8 Drawing Sheets

SPRAY BOTTLE HAVING ROTATABLE STEM AND ASSOCIATED METHODS

FIELD OF THE INVENTION

The present invention relates to systems and methods for dispensing liquids from spray bottles. More specifically, the present invention is directed to a system for positioning a liquid uptake mechanism of a spray bottle assembly at the lowermost location along the bottom of the spray bottle, regardless of the orientation of the spray bottle.

BACKGROUND

Many differing devices are developed yearly to improve and make more convenient the use of liquids such as cleaning agents, lubricants, moisteners, beauty aids such as perfumes, fragrant waters, and other substances which can be stored or held in a container and sprayed in a mist or aerosol form. Pressurized containers with their necessary gaseous agents, which are sometimes environmentally unfriendly, have in some measure lost ground to conventional spray bottles producing an "atomized" mist.

One of the challenges for consumers, which is sometimes addressed by product manufacturers, is the amount of liquid left inside the spray bottle when the source or feed tube cannot efficiently reach the last fraction of liquid. That fraction is essentially unavailable to the user, which is especially frustrating when the remaining liquid is needed for the current purpose. Moreover, if the near empty bottle is discarded, product is wasted. For the value-conscious consumer, a primary alternative is to wait until a new bottle of product is obtained at which point the remaining fraction from the old bottle is added to the new bottle so that effectively no product is wasted.

In the case where a spray bottle is low on product, the spray delivered from the nozzle may often times contain too much air resulting in a less than desired amount of product delivered out the nozzle. Some manufacturers have attempted to solve this problem by providing longer source or feed tubes to try to extract as much product as possible, thereby minimizing waste. Other manufacturers have even produced bottles with small pumps run by batteries, with the object of using as much product as possible, thereby minimizing waste. The problems with such an approach are multiple. For example, the cost of the container may be higher, thereby increasing the consumer's product cost. Additionally, utilizing the pump solution may introduce environmentally unfriendly batteries to the waste stream. This trade off may or may not be balanced by the reduction of product which enters the municipal waste stream.

What is needed is a spray bottle designed to allow the maximum amount of product to be used without increasing cost or necessitating the use of components potentially harmful to the environment when discarded.

Another problem associated with the use of atomizing or spray bottles is the need to keep the bottle substantially upright when in use. Because of natural gravitational forces, liquid seeks to find its own level. Without pressurizing a spray or atomizing bottle, the same forces affect the performance of such devices. Therefore, if the user desires to hold the bottle in one position where the level of the bottle inhibits the ability of the feed or source tube to draw liquid uninhibited, then poor delivery of product results. This is particularly true when the volume of product in the bottle is at or below approximately 50%. At this point, the bottle must be kept substantially upright in order for the suction tube to continue to feed product to the spray nozzle. Once the suction tube draws a sufficient amount of air, the bottle then must be returned to the upright position and the trigger squeezed continually to draw a sufficient amount of product into the suction tube to feed the nozzle. Most consumers have experienced the frustration associated with this condition when trying to deliver product only to be annoyed by the constant interruption of product flow and having to re-position the spray bottle and continually squeeze the trigger to continue with the desired operation—a very inefficient way to apply product to the desired target or surface.

What is needed then is a spray bottle which is not inhibited by the gravitational forces which move the liquid level as the position of the spray bottle is changed.

This background information is provided to reveal information believed by the applicant to be of possible relevance to the present invention. No admission is necessarily intended, nor should be construed, that any of the preceding information constitutes prior art against the present invention.

SUMMARY OF THE INVENTION

With the above in mind, embodiments of the present invention are related to a liquid take-up mechanism to be used in connection with a spray bottle. The liquid take-up mechanism may have first and second vertical tube sections, an internal member capture, a horizontal tube section, an angled tube section, and a rotation connection member. The first vertical tube section may have a first vertical tube section first end portion and an opposing first vertical tube section second end portion. The internal member capture may be adjacent to the first vertical tube section second end portion. The second vertical tube section may have a second vertical tube section first end portion located adjacent to the internal member capture. The second vertical tube section may also have a second vertical tube section second end portion opposing the second vertical tube section first end portion. The horizontal tube section may have a horizontal tube section first end portion secured to the second vertical tube section second end portion. The horizontal tube section may have a horizontal tube section second end portion opposing the horizontal tube section first end portion. The angled tube section may have an angled tube section first end portion secured to the horizontal tube section second end portion. The rotation connection member may have a housing and an internal member. The housing may have a housing first end and an opposing housing second end. The internal member may be carried by the internal member capture. At least a portion of the first vertical tube section may be adapted to be carried by the housing first end. At least a portion of the second vertical tube section may be adapted to be carried by the housing second end. The internal member may be adapted to interface between the first vertical tube section and the second vertical tube section. The second vertical tube section may be able to freely rotate with respect to the first vertical tube section.

The first vertical tube section, the second vertical tube section, the horizontal tube section, and the angled tube section may be individually separable components.

The housing may be a two piece housing that includes an upper housing member and a lower housing member.

The upper housing member and the first vertical tube section may be integrally formed as a monolithic unit.

The internal member may be a gasket.

The internal member capture outer perimeter may be greater than an outer perimeter of the first vertical tube section and greater than an inner perimeter of the housing first end.

A second vertical tube section first end may be a flange. The flange may have an outer perimeter greater than an inner perimeter of the lower housing member first end and less than an inner perimeter of the upper housing member second end.

The liquid take-up mechanism may have a protuberance. The protuberance may extend from the flange and be configured to be received by the internal member.

The horizontal tube section second end portion may be weighted.

The spray bottle system may have a container, a cap, and a liquid take-up mechanism. The cap may be removably connected to the container. The liquid take-up mechanism may be removably connected to the cap. The liquid take-up mechanism may have a first vertical tube section, which may have a first vertical tube section first end portion removably connected to the cap.

The angled tube section may be sized to extend to an interior bottom portion of the container.

The medial bottom portion of the container may be elevated with respect to outer peripheral bottom portions of the container.

DETAILED DESCRIPTION OF THE INVENTION

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Those of ordinary skill in the art realize that the following descriptions of the embodiments of the present invention are illustrative and are not intended to be limiting in any way. Other embodiments of the present invention will readily suggest themselves to such skilled persons having the benefit of this disclosure. Like numbers refer to like elements throughout.

Although the following detailed description contains many specifics for the purposes of illustration, anyone of ordinary skill in the art will appreciate that many variations and alterations to the following details are within the scope of the invention. Accordingly, the following embodiments of the invention are set forth without any loss of generality to, and without imposing limitations upon, the claimed invention.

In this detailed description of the present invention, a person skilled in the art should note that directional terms, such as "above," "below," "upper," "lower," and other like terms are used for the convenience of the reader in reference to the drawings. Also, a person skilled in the art should notice this description may contain other terminology to convey position, orientation, and direction without departing from the principles of the present invention.

Furthermore, in this detailed description, a person skilled in the art should note that quantitative qualifying terms such as "generally," "substantially," "mostly," and other terms are used, in general, to mean that the referred to object, characteristic, or quality constitutes a majority of the subject of the reference. The meaning of any of these terms is dependent upon the context within which it is used, and the meaning may be expressly modified.

Figure 1:
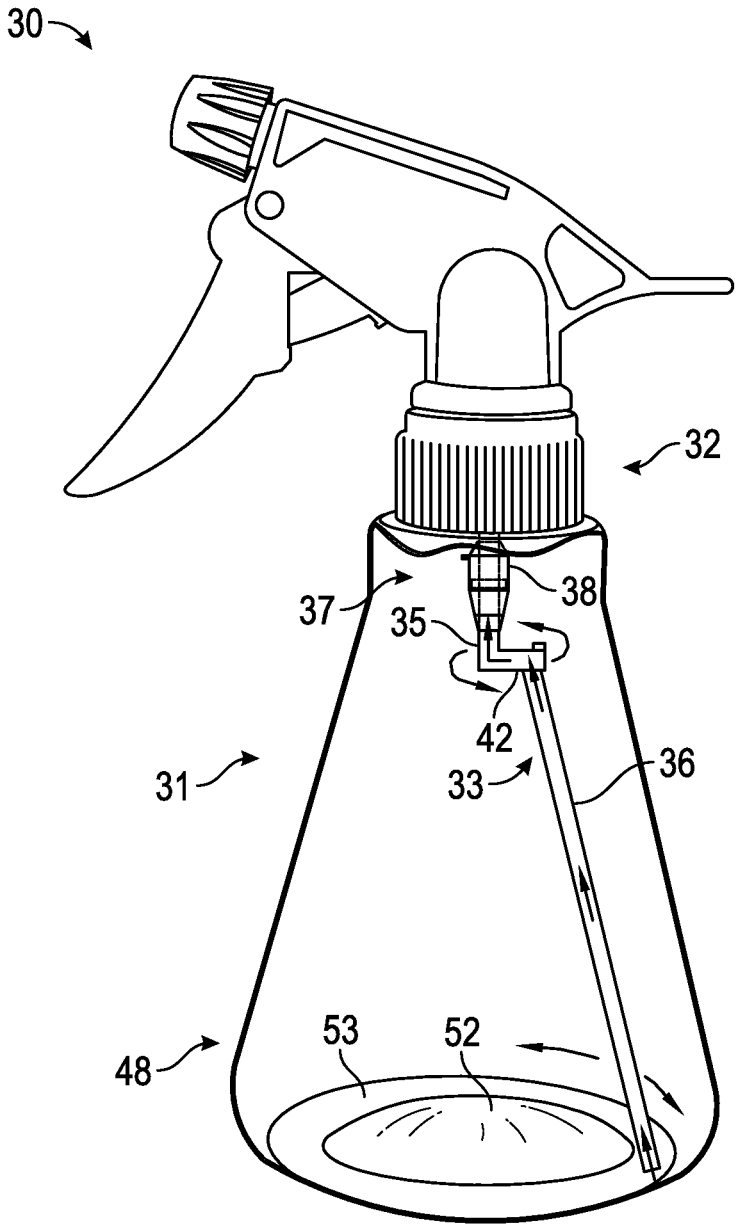
FIG. 1 is a side view of a spray bottle system according to an embodiment of the present invention.
Figure 2:
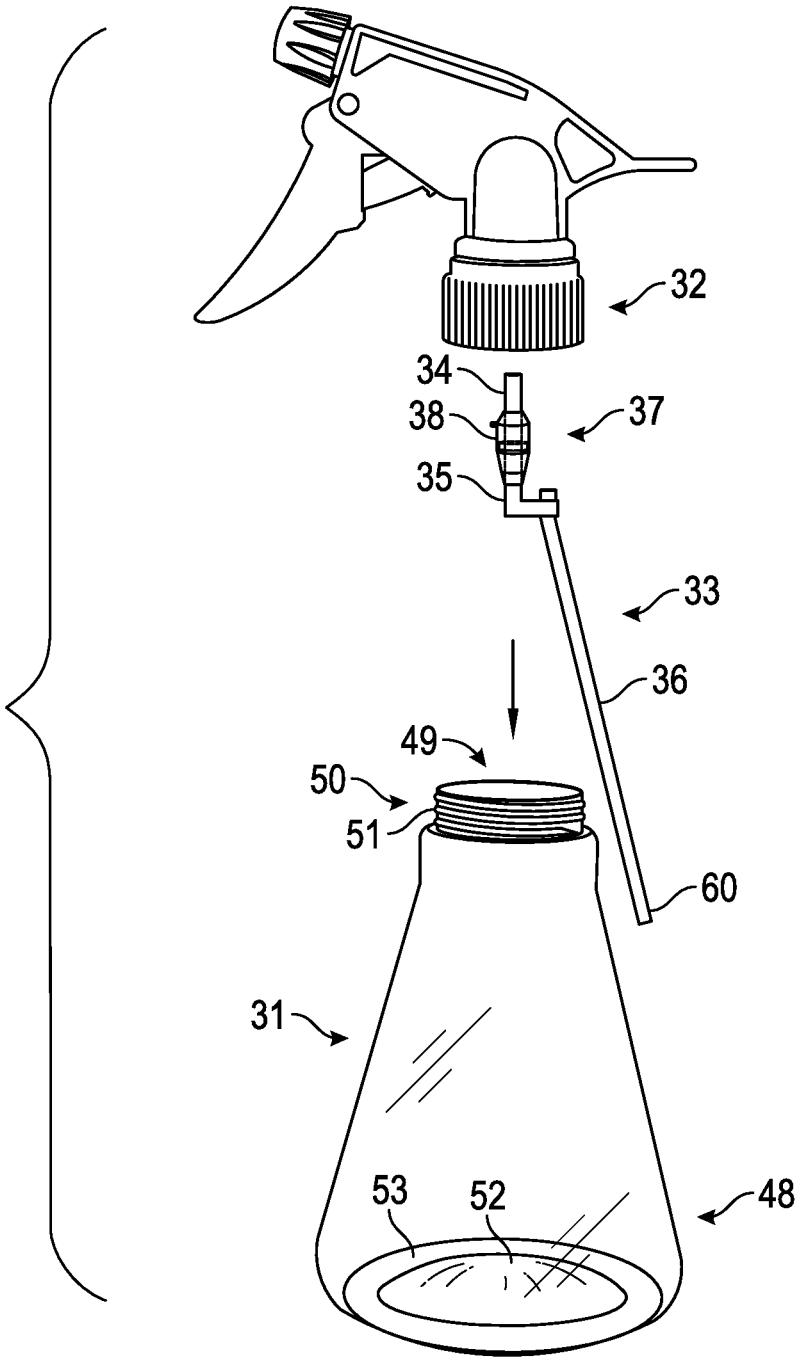
FIG. 2 is an exploded side view of the spray bottle system of FIG. 1.

An embodiment of the invention, as shown and described by the various figures and accompanying text provides a liquid take-up mechanism 33 that may be used in connection with a spray bottle system 30. Turning to FIGS. 1 & 2, a spray bottle system 30 is shown. The spray bottle system 30 may have a container 31, a cap 32, and a liquid take-up mechanism 33.

The container 31 may be configured to retain fluid. The container 31 may have an interior bottom portion 48. The interior bottom portion 48 may have a medial bottom portion 52 surrounded by outer peripheral bottom portions 53. The medial bottom portion 52 may be elevated with respect to the outer peripheral bottom portions 53.

The cap 32 may be removably connected to the container 31. The cap 32 may be removably connected to the liquid take-up mechanism 33. Specifically, the cap 32 may be removable connected to a first vertical tube section first end portion 59.

Figure 3:
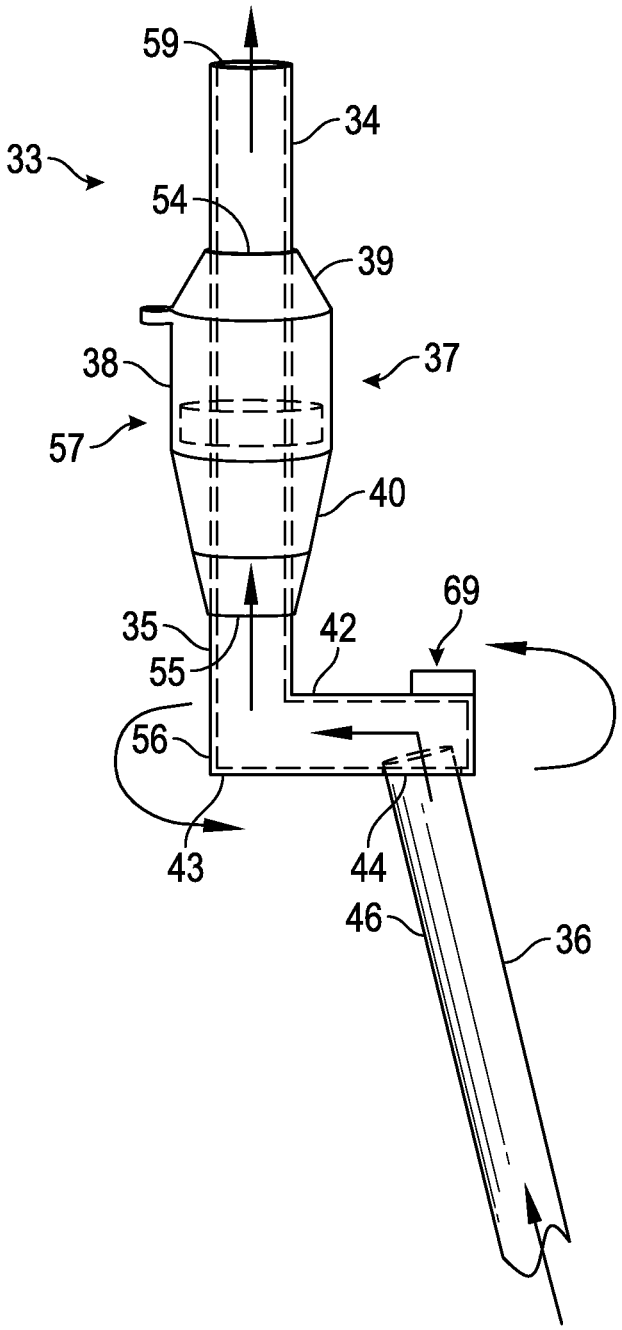
FIG. 3 is a side view of an upper portion of the liquid take-up mechanism of the spray bottle system of FIG. 1.

The liquid take-up mechanism 33 may be used in connection with a spray bottle. As shown in FIG. 3, the liquid take-up mechanism may have a first vertical tube section 34, an internal member capture 57, a second vertical tube section 35, a horizontal tube section 42, and angled tube section 36, and a rotation connection member 37. The liquid take-up mechanism 33 may extend to the bottom of the spray bottle and dynamically orient itself to draw liquid from the lowermost portion of the spray bottle.

The first vertical tube section 34 may have a first vertical tube section first end portion 59 and an opposing first vertical tube section second end portion 58. The first vertical tube section 34 may be a hollow cylindrical tube. The first vertical tube section 34 may be rigid or flexible.

The internal member capture 57 may be disposed adjacent the first vertical tube section second end portion 58. The internal member capture 57 may be configured to retain an internal member 41. The internal member capture 57 may be secured to the first vertical tube section second end portion 58. The internal member capture 57 may be secured to the second vertical tube section first end portion 45. The internal member capture 57 may be adjacent to the first vertical tube section second end portion 58. The internal member capture 57 may be adjacent to the second vertical tube section first end portion 45. The internal member capture 57 may have an outer perimeter greater than an outer perimeter of the first vertical tube section 34. The internal member capture 57 outer perimeter may be greater than the inner perimeter of a housing first end 54. The internal member capture 57 outer perimeter may be greater than an inner perimeter of an upper housing member first end 54.

The second vertical tube section 35 may have a second vertical tube section first end portion 45 and an opposing second vertical tube section second end portion 56. The second vertical tube section 35 may be a hollow cylindrical tube. The second vertical tube section 35 may be rigid or flexible. The second vertical tube section first end portion 45 may be located adjacent to the internal member capture 57. The second vertical tube section first end portion 45 may be adapted to interface with the first vertical tube section second end portion 58. The first vertical tube section 34 may be vertically aligned with the second vertical tube section 35. To be vertically aligned may mean that the first vertical tube section 34 and the second vertical tube section 35 have longitudinal axes on a common line. The second vertical tube section 35 may be adapted to freely rotate about its longitudinal axis with respect to the first vertical tube section 34.

The horizontal tube section 42 may have a horizontal tube section first end portion 43 and an opposing horizontal tube section second end portion 44. The horizontal tube section 42 may be a hollow cylindrical tube. The horizontal tube section 42 may be rigid or flexible. The horizontal tube section first end portion 43 may secure to the second vertical tube section second end portion 56. The horizontal tube section 42 may extend away from the second vertical tube section 35 with a longitudinal axis orthogonal to the longitudinal axis of the second vertical tube section 35. The horizontal tube section 42 longitudinal axis may not be in a common line with the longitudinal axis of the first vertical tube section 34 or the second vertical tube section 35. When secured to the second vertical tube section 35, the horizontal tube section 42 may form a 90° angle with the second vertical tube section 35. When the second vertical tube section 35 is secured to the horizontal tube section 42, the smallest angle between the two components may range from 90° to 135°. The horizontal tube section second end portion 44 may be located an equal or smaller vertical distance from the outer peripheral bottom portions 53 of the container 31 when compared to the horizontal tube section first end portion 43. The second vertical tube section second end portion 56 may be adapted to receive and retain the horizontal tube section first end portion 43. The horizontal tube section first end portion 43 may be adapted to receive and retain the second vertical tube section second end portion 56. The second vertical tube section 35 and the horizontal tube section 42 may be formed as a monolithic unit.

The angled tube section 36 may have an angled tube section first end portion 46 and an opposing angled tube section second end portion 60. The angled tube section 36 may be a hollow cylindrical tube. The angled tube section 36 may be rigid or flexible. The angled tube section first end portion 46 may secure to the horizontal tube section second end portion 44. The angled tube section first end portion 46 may be adapted to secure and carry the horizontal tube section second end portion 44. The horizontal tube section second end portion 44 may be adapted to secure and carry the angled tube section first end portion 46. The angled tube section 36 and the horizontal tube section 42 may be formed as a monolithic unit. The angled tube section 36 may extend away from the horizontal tube section 42. The angled tube section 36 may be sized to extend to the interior bottom portion 48 of the container 31.

When secured to the horizontal tube section 42, the angled tube section 36 may form an angle greater than 90° with the horizontal tube section 42. The angled tube section second end portion 60 may be located a closer horizontal distance to the outer peripheral bottom portions 53 of the container 31 when compared to the angled tube section first end portion 46. The angled tube section second end portion 60 may be positioned adjacent the outer peripheral bottom portions 53 of the container 31.

Figure 4:
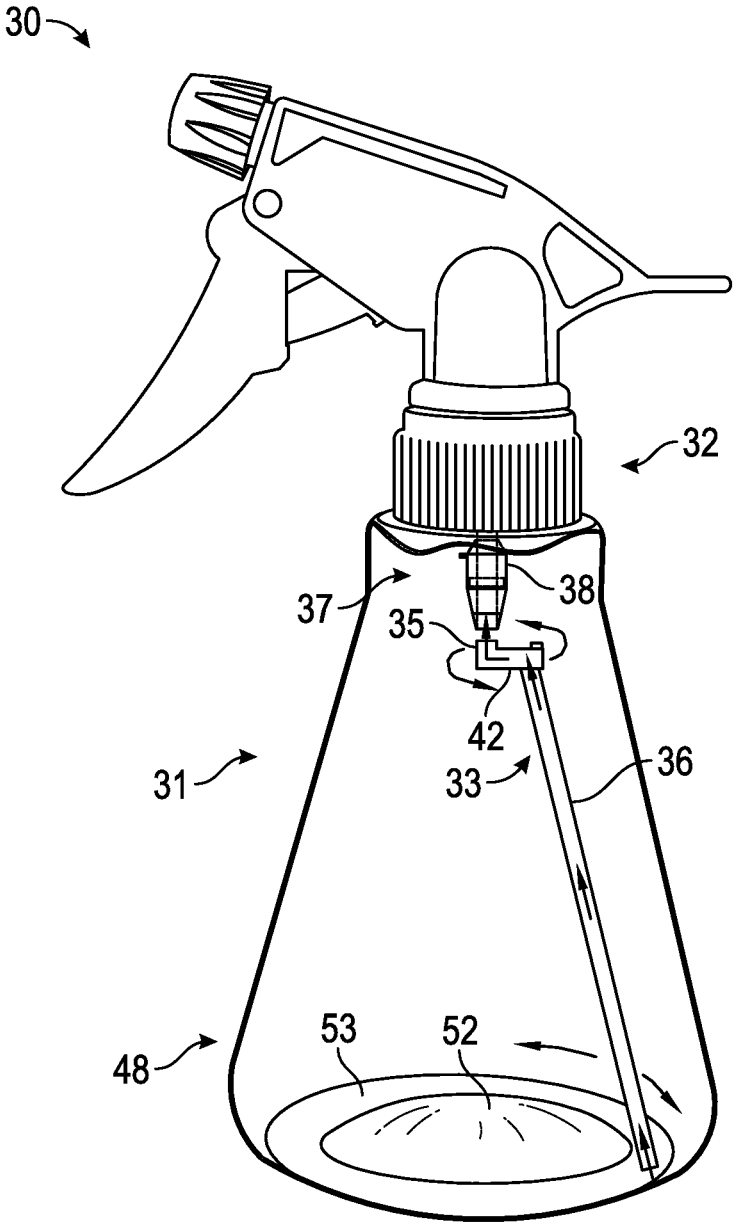
FIG. 4 is a side view of a spray bottle system according to another embodiment of the present invention.
Figure 5:
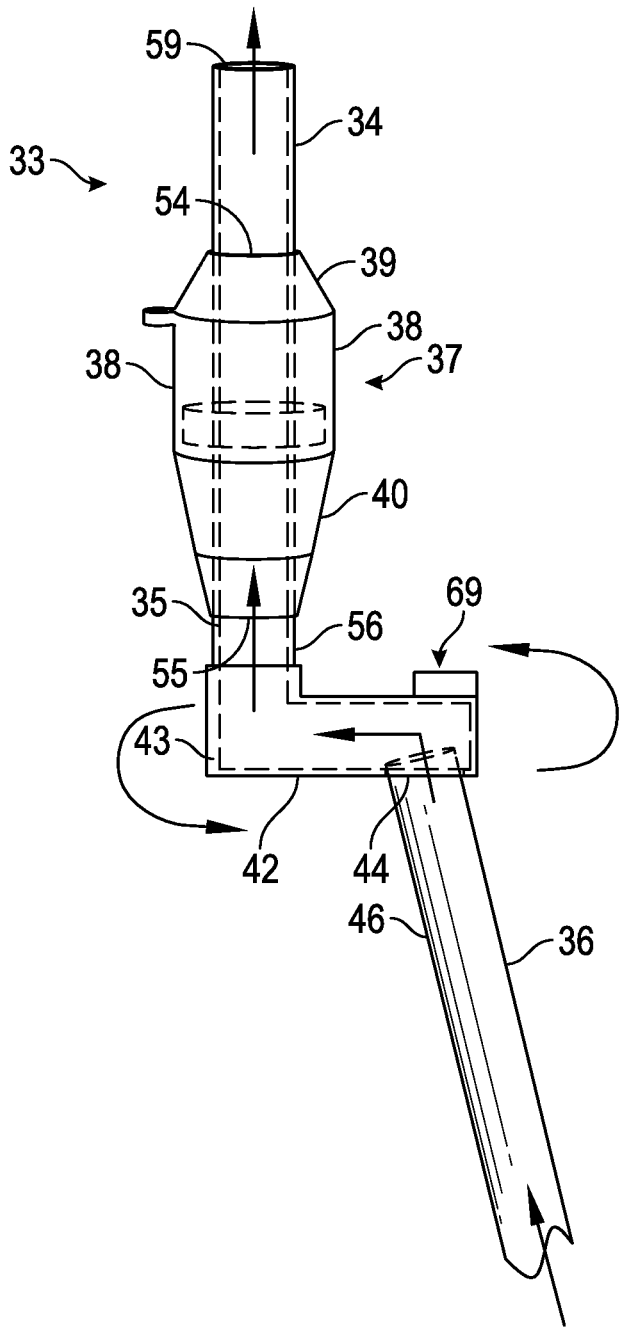
FIG. 5 is a side view of an upper portion of the liquid take-up mechanism of the spray bottle system of FIG. 4.
Figure 7:
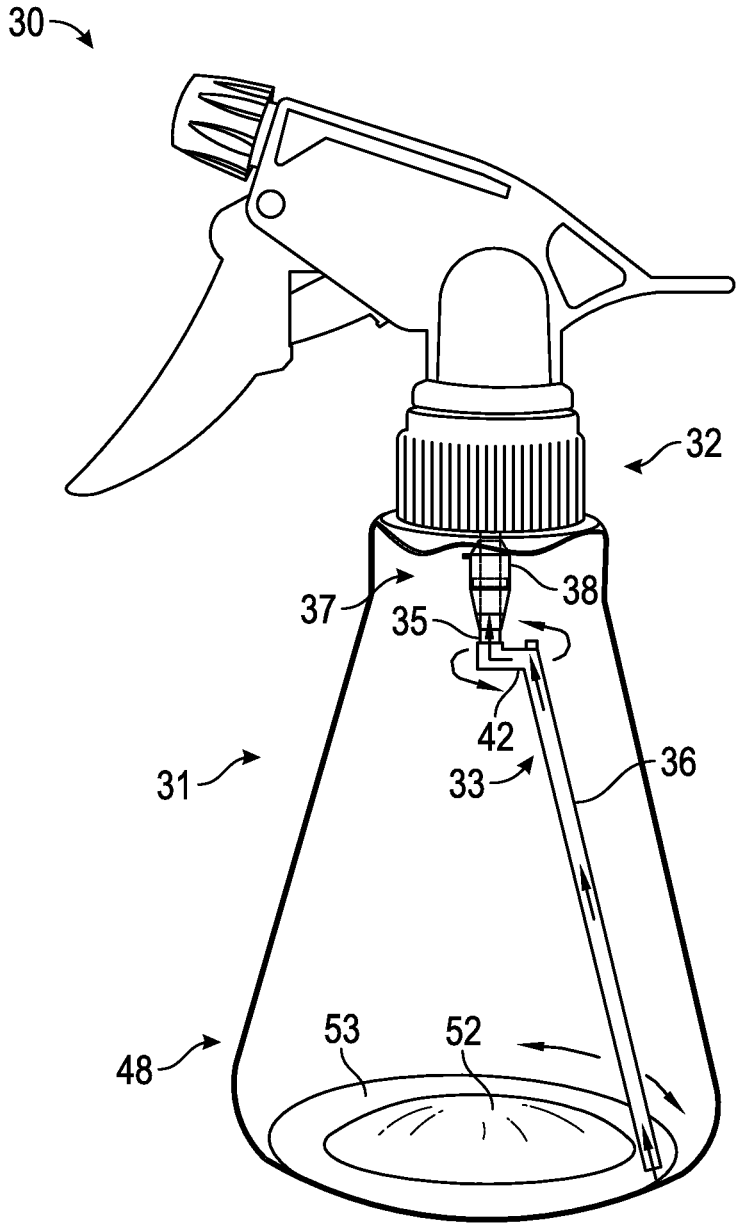
FIG. 7 is a side view of a spray bottle system according to yet another embodiment of the present invention.
Figure 8:
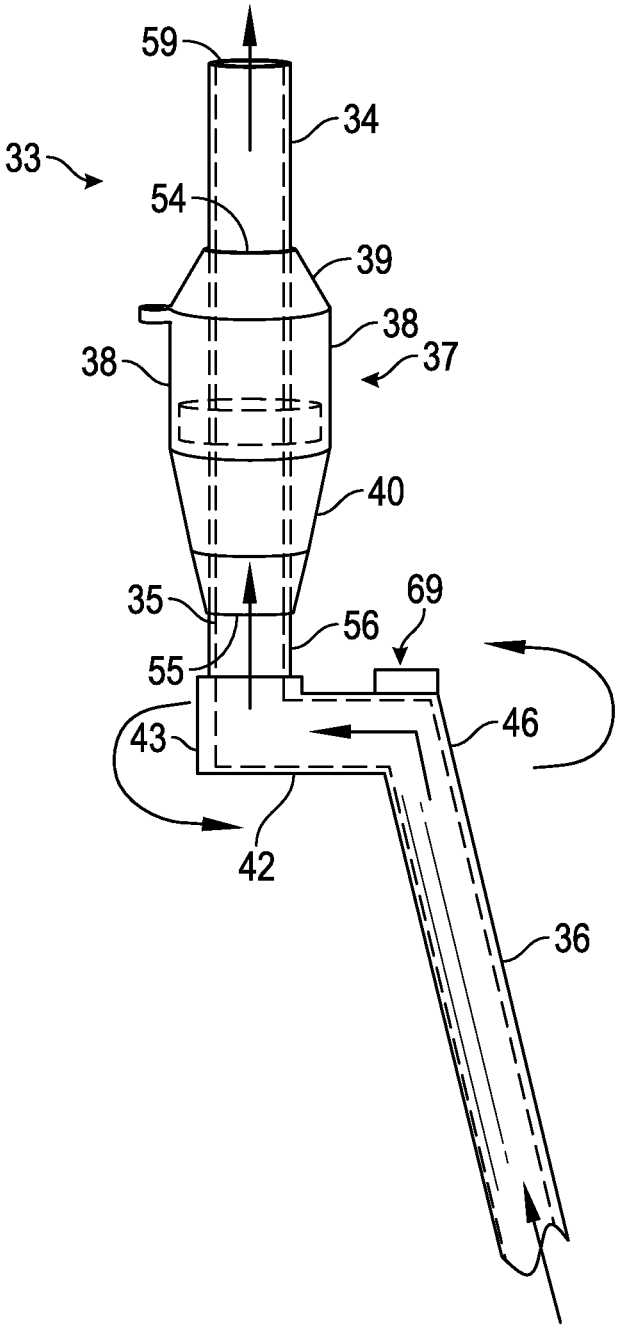
FIG. 8 is a side view of an upper portion of the liquid take-up mechanism of the spray bottle system of FIG. 6.

The first vertical tube section 34, second vertical tube section 35, horizontal tube section 42, and angled tube section 42 may each be individual, separable components. Any combination of the second vertical tube section 35, horizontal tube section 42, and angled tube section 42 may be individual separable components or formed together as a monolithic unit. As depicted in FIGS. 1-3, the first vertical tube section 34 and angled tube section 42 are individual, separable components while the second vertical tube section 35 and the horizontal tube section 42 are formed as a monolithic unit. As depicted in FIGS. 4 & 5, the first vertical tube section 34, second vertical tube section 34, horizontal tube section 43, and angled tube section 42 are each separable components. As depicted in FIGS. 7 & 8, the first vertical tube section 34 and second vertical tube section 35 are individual, separable components while the horizontal tube section 42 and the angled tube section 42 are formed as a monolithic unit.

The rotation connection member 37 may have a housing 38 and an internal member 41. The rotation connection member 37 may be adapted to secure the second vertical tube section 35 to the first vertical tube section 34 while allowing the second vertical tube section 35 to rotate about its longitudinal axis.

Figure 6:
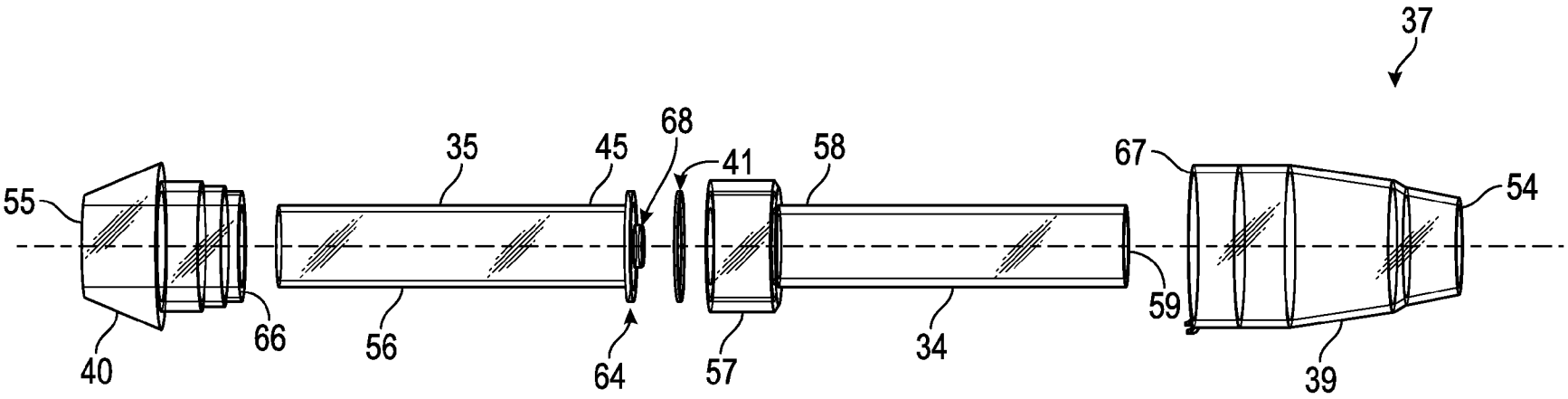
FIG. 6 is an exploded side view of the rotation connection member of the spray bottle system of FIG. 4.

As depicted in FIG. 6, the housing 38 may have a housing first end 54 and an opposing housing second end 55. The housing first end 54 may carry at least a portion of the first vertical tube section 34. The housing second end 55 may carry at least a portion of the second vertical tube section 35. The housing 38 may be adapted to form a hollow tube along the longitudinal axis of the housing 38. The hollow tube may extend from the housing first end 54 through the entirety of the housing 38 to the housing second end 55. The hollow tube may be adapted to carry at least a portion of the first vertical tube section 34 and the second vertical tube section 35. The hollow tube may have an inner diameter at least as large as the outer diameter of the first vertical tube section 34 and the second vertical tube section 35. The hollow tube may have an inner diameter that is larger than the outer diameter of the second vertical tube section 35. The hollow tube may be adapted to allow the second vertical tube section 35 to rotate freely about its longitudinal access when the second vertical tube section 35 is located within the hollow tube and carried by the housing 38.

The housing 38 may be a two piece housing with an upper housing member 39 and a lower housing member 40. The upper housing member 39 may carry at least a portion of the first vertical tube section 34. The housing 38 may carry the internal member capture 57. More specifically, the upper housing member 39 may carry the internal member capture 57. The lower housing member 40 may carry at least a portion of the second vertical tube section 35. The upper housing member 39 may be adapted to removable secure to the lower housing member 40. The upper housing member 39 may utilize a compression fit to secure to the lower housing member 40. A portion of the lower housing member 39 may be secured and retained within the upper housing member 40. A portion of the upper housing member 40 may be secured and retained within the lower housing member 39.

The upper housing member 39 may be adapted to carry the first vertical tube section second end portion 58. The lower housing member 40 may be adapted to carry the second vertical tube section first end portion 45. When secured to one another, the upper housing member 39 and the lower housing member 40 may be adapted to secure the first vertical tube section second end portion 58 adjacent to the internal member capture 57. The upper housing member 39 and the lower housing member 40 may be adapted to secure the second vertical tube section first end portion 45 adjacent to the internal member capture 57.

The upper housing member 39 and the first vertical tube section 34 may be integrally formed as a monolithic unit.

The internal member 41 may be disposed between the first vertical tube section second end portion 58 and the second vertical tube section first end portion 45. The internal member 41 may be carried by the internal member capture 57. Such a configuration may allow fluid to be carried from the container 31 through the tube sections 36, 42, 35, 34 of the liquid take-up mechanism 33. The internal member 41 may be adapted to interface between the first vertical tube section second end portion 58 and the second vertical tube section first end portion 45. The internal member 41 may provide a reduced friction surface and be adapted to allow the second vertical tube section 35 to rotate freely and independently about its longitudinal axis. The internal member 41 may be a cylindrical gasket. The internal member 41 may be adapted to form an airtight seal between the first vertical tube section 34 and the second vertical tube section 35.

The second vertical tube section first end portion 45 may comprise a flange 64. The flange may be configured to contact the surface of the internal member 41 proximate the second vertical tube section 35. The flange 64 may have a flange outer perimeter greater than the second vertical tube section 35 outer perimeter. The flange 64 may have a flange outer perimeter greater than the lower housing member first end 66 inner perimeter. The flange 64 may have a flange outer perimeter less than an upper housing member second end 67 inner perimeter.

A protuberance 68 may be secured to the flange 64 and extend from the flange 64 distal the second vertical tube section 35. The protuberance 68 may be adapted to contact the internal member 41. The protuberance 68 may be adapted to be received within an inner circumference of the internal member 41. The protuberance 68 may be adapted to contact an inner circumference of the internal member 41 and further adapted to form an airtight seal with the internal member 41. The protuberance may be a raised perimeter disposed on the flange about the inner perimeter of the second vertical tube section 42.

By way of example, and not as a limitation, the internal member capture 57 may be affixed to the first vertical tube section second end portion 58. The flange 64 may form the outermost surface of the second vertical tube section first end portion 45. The internal member 41 may be carried by the internal member capture 57. The flange may be configured to contact the internal member 41. The outer perimeter of the internal member capture 57 may be greater than the outer perimeter of the first vertical tube section 35. The outer perimeter of the internal member capture 57 may also be greater than the inner perimeter of the upper housing member first end 54. This may allow the first vertical tube section first end portion 59 to be passed through the upper housing member first end 54. However, the larger dimension of the internal member capture 57 outer perimeter may prevent the first vertical tube section second end portion 58 from passing through the upper housing member first end 54. The flange 64 may have an outer perimeter equal to the outer diameter of the internal member capture 57. The flange 64 may have an outer perimeter greater than the outer perimeter of the second vertical tube section 35. The flange 64 may have an outer perimeter greater than the lower housing member first end 66 inner perimeter. This may allow the second vertical tube section second end portion 56 to be passed through the lower housing member first end 66. However, the larger dimension of the flange 64 outer perimeter may prevent the second vertical tube section first end portion 45 from passing through the lower housing member second end 55. The upper housing member 39 may be secured to the lower housing member 40. The housing 38 may be adapted to compress the flange 64 against the internal member 41. The protuberance 68 may be located on the flange 64 distal the second vertical tube section 35. The protuberance 68 may be sized and adapted to be received by an inner perimeter of the internal member 41.

At least a portion of the horizontal tube section 42 or the angled tube section 36 may be weighted. The horizontal tube section second end portion 44 may be weighted. A tube portion may be weighted if additional mass is located on the tube portion. As depicted at least in FIG. 3, the additional mass may be a weight 69 affixed to the horizontal tube section 42. The weighting of a tube section may cause gravity to urge the weighted section toward the lowermost portion of the container 31. This may cause the second vertical tube section 35 to rotate with respect to the first vertical tube section 34 and position the angled tube section second end portion 60 at the lowest point of the outer peripheral bottom portion 53 of the container 31, thus allowing the liquid take-up mechanism 33 to access any liquid remaining in the container 31 even when the container 31 is not maintained at a level horizontal angle.

Some of the illustrative aspects of the present invention may be advantageous in solving the problems herein described and other problems not discussed which are discoverable by a skilled artisan.

While the above description contains much specificity, these should not be construed as limitations on the scope of any embodiment, but as exemplifications of the presented embodiments thereof. Many other ramifications and variations are possible within the teachings of the various embodiments. While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best or only mode contemplated for carrying out this invention, but that the invention will include all embodiments falling within the scope of the appended claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

Thus the scope of the invention should be determined by the appended claims and their legal equivalents, and not by the examples given.

That which is claimed is:

1. A liquid take-up mechanism to be used in connection with a spray bottle, the liquid take-up mechanism comprising:

a first vertical tube section, having a first vertical tube section first end portion and an opposing first vertical tube section second end portion;

an internal member capture adjacent to the first vertical tube section second end portion;

a second vertical tube section having a second vertical tube section first end portion, located adjacent to the internal member capture, and an opposing second vertical tube section second end portion;

a horizontal tube section, having a horizontal tube section first end portion, secured to the second vertical tube section second end portion, and a horizontal tube section second end portion;

an angled tube section, having an angled tube section first end portion secured to the horizontal tube section second end portion; and a rotation connection member comprising:

a housing having a housing first end and an opposing housing second end, and an internal member carried by the internal member capture;

wherein the first vertical tube section, the second vertical tube section, the horizontal tube section, and the angled tube section are individually separable components;

wherein at least a portion of the first vertical tube section is adapted to be carried by the housing first end;

wherein at least a portion of the second vertical tube section is adapted to be carried by the housing second end;

wherein the internal member is adapted to interface between the first vertical tube section and the second vertical tube section; and wherein the second vertical tube section is adapted to freely rotate with respect to the first vertical tube section.

2. The liquid take-up mechanism according to claim 1 wherein the housing is a two piece housing that includes an upper housing member and a lower housing member.

3. The liquid take-up mechanism according to claim 2 wherein the upper housing member and the first vertical tube section are integrally formed as a monolithic unit.

4. The liquid take-up mechanism according to claim 1 wherein the internal member further comprises a gasket.

5. The liquid take-up mechanism according to claim 1 wherein the internal member capture has an internal member capture outer perimeter greater than an outer perimeter of the first vertical tube section and greater than an inner perimeter of the housing first end.

6. The liquid take-up mechanism according to claim 1 wherein the second vertical tube section first end comprises a flange.

7. The liquid take-up mechanism according to claim 6 wherein the flange has an outer perimeter greater than an inner perimeter of the housing first end and less than an inner perimeter of the housing second end.

8. The liquid take-up mechanism according to claim 6 further comprising:

a protuberance extending from the flange and configured to be received by the internal member.

9. The liquid take-up mechanism according to claim 1 wherein the horizontal tube section second end portion is weighted.

10. A spray bottle system comprising:

a container;

a cap that is removeably connected to the container; and a liquid take-up mechanism that is removably connected to the cap, the liquid take-up mechanism comprising:

a first vertical tube section, having a first vertical tube section first end portion, removably connected to the cap, and an opposing first vertical tube section second end portion, an internal member capture adjacent to the first vertical tube section second end portion, a second vertical tube section having a second vertical tube section first end portion, located adjacent to the internal member capture, and an opposing second vertical tube section second end portion;

a horizontal tube section, having a horizontal tube section first end portion, secured to the second vertical tube section second end portion, and a horizontal tube section second end portion;

an angled tube section, having an angled tube section first end portion secured to the horizontal tube section second end portion; and a rotation connection member comprising:

a housing having a housing first end and an opposing housing second end, and an internal member carried by the internal member capture;

wherein the first vertical tube section, the second vertical tube section, the horizontal tube section, and the angled tube section are individually separable components;

wherein at least a portion of the first vertical tube section is adapted to be carried by the housing first end;

wherein at least a portion of the second vertical tube section is adapted to be carried by the housing second end;

wherein the internal member is adapted to interface between the first vertical tube section and the second vertical tube section; and wherein the second vertical tube section is adapted to freely rotate with respect to the first vertical tube section.

11. The spray bottle system according to claim 10 wherein the housing is a two piece housing that includes an upper housing member and a lower housing member.

12. The spray bottle system according to claim 10 wherein the internal member further comprises a gasket.

13. The spray bottle system according to claim 10 wherein the internal member capture has an outer perimeter greater than an outer perimeter of the first vertical tube section and greater than an inner perimeter of the housing first end.

14. The spray bottle system according to claim 10 wherein the second vertical tube section first end portion further comprises a flange.

15. The spray bottle system according to claim 14 wherein the flange has and outer perimeter greater than an inner perimeter of the housing first end and less than an inner perimeter of the housing second end.

16. The spray bottle system according to claim 14 further comprising:

a protuberance extending from the flange and configured to be received by the internal member.

17. The spray bottle system according to claim 10 wherein the angled tube section is sized to extend to an interior bottom portion of the container.

18. The spray bottle system according to claim 10 wherein a medial bottom portion of the container is elevated with respect to outer peripheral bottom portions of the container.

19. A spray bottle system comprising:

a container;

a cap that is removably connected to the container; and a liquid take-up mechanism that is removably connected to the cap, the liquid take-up mechanism comprising:

a first vertical tube section, having a first vertical tube section first end portion, removably connected to the cap, and an opposing first vertical tube section second end portion, an internal member capture disposed adjacent the first vertical tube section second end portion, having an outer perimeter greater than a first vertical tube section outer perimeter;

a second vertical tube section having a flange, adjacent to the internal member capture, and an opposing second vertical tube section second end portion;

a protuberance extending from the flange;

a horizontal tube section, having a horizontal tube section first end portion, secured to the second vertical tube section second end portion, and a horizontal tube section second end portion that is weighted;

an angled tube section sized to extend to an interior bottom portion of the container, having an angled tube section first end portion secured to the horizontal tube section second end portion; and a rotation connection member comprising:

a housing having a housing first end and an opposing housing second end, and a gasket configured to be retained by the internal member capture and to receive the flange;

wherein the first vertical tube section, the second vertical tube section, the horizontal tube section, and the angled tube section are individually separable components;

wherein the internal member capture outer perimeter is greater than a housing first end inner perimeter;

wherein a flange outer perimeter is greater than a lower housing member first end inner perimeter and less than an upper housing member second end inner perimeter;

wherein at least a portion of the first vertical tube section is adapted to be carried by the housing first end;

wherein at least a portion of the second vertical tube section is adapted to be carried by the housing second end;

wherein a medial bottom portion of the container is elevated with respect to outer peripheral bottom portions of the container;

wherein the gasket is adapted to interface between the first vertical tube section and the second vertical tube section; and wherein the second vertical tube section is able to freely rotate with respect to the first vertical tube section.

* * * * *